US009466447B2

(12) United States Patent
Von Allmen et al.

(10) Patent No.: US 9,466,447 B2
(45) Date of Patent: Oct. 11, 2016

(54) DEVICE FOR ACTUATING THE CONTACTS OF A CIRCUIT BREAKER, COMPRISING A TORSION ROD

(71) Applicant: Alstom Technology Ltd., Baden (CH)

(72) Inventors: Peter Von Allmen, Buchs (CH); Benoît De Lussy, Zurich (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 18 days.

(21) Appl. No.: 14/396,137

(22) PCT Filed: Apr. 25, 2013

(86) PCT No.: PCT/EP2013/058645

§ 371 (c)(1),
(2) Date: Oct. 22, 2014

(87) PCT Pub. No.: WO2013/160409

PCT Pub. Date: Oct. 31, 2013

(65) Prior Publication Data

US 2015/0108092 A1 Apr. 23, 2015

(30) Foreign Application Priority Data

Apr. 26, 2012 (FR) ..... 12 53872

(51) Int. Cl.
*H01H 1/50* (2006.01)
*H01H 33/42* (2006.01)
(Continued)

(52) U.S. Cl.
CPC ..... *H01H 33/42* (2013.01); *H01H 3/3042* (2013.01); *H01H 33/30* (2013.01); *H01H 33/40* (2013.01); *H01H 2235/01* (2013.01)

(58) Field of Classification Search
CPC ..... H01H 1/50; H01H 3/00; H01H 3/02; H01H 3/04; H01H 3/06; H01H 3/22; H01H 3/32; H01H 3/40; H01H 3/44; H01H 3/46; H01H 3/48; H01H 71/00; H01H 71/10; H01H 71/66; H01H 2003/00; H01H 2003/02; H01H 2003/30; H01H 2003/3078; H01H 2003/32; H01H 2003/40; H01H 2003/46; H01H 2221/06
USPC ..... 200/250, 242
See application file for complete search history.

(56) References Cited

U.S. PATENT DOCUMENTS 3,227,244 A 1/1966 Pelenc
4,302,646 A 11/1981 Osborne et al.

(Continued)

FOREIGN PATENT DOCUMENTS

DE 1515590 A1 7/1969
EP 0325746 A2 8/1989

(Continued)

OTHER PUBLICATIONS

International Preliminary Report on Patentability issued in Application No. PCT/EP2013/058645 dated Jun. 4, 2014.

(Continued)

*Primary Examiner* — Renee Luebke
*Assistant Examiner* — Anthony R. Jimenez
(74) *Attorney, Agent, or Firm* — Pearne & Gordon LLP

(57) ABSTRACT

A circuit breaker has a stationary contact and a movable contact, and an actuator device for actuating it comprises a rigid drive shaft (8) that drives the movable contact, first resilient means for driving the movable contact, and a torsion bar (2) for driving the drive shaft, the torsion bar (2) being suitable for being deformed in twisting in order to assist the resilient means during an initial period while opening the contacts of the circuit breaker. The torsion bar (2) is housed inside the drive shaft (8). A first end (4) of the torsion bar (2) is constrained to turn with a ring (10). A second end (6) of the torsion bar (2) is constrained to turn with the drive shaft (8).

7 Claims, 3 Drawing Sheets

(51) Int. Cl.

| | |
|---|---|
| ***H01H 3/30*** | (2006.01) |
| ***H01H 33/30*** | (2006.01) |
| ***H01H 33/40*** | (2006.01) |

(56) References Cited

U.S. PATENT DOCUMENTS

| | | | |
|---|---|---|---|
| 8,191,444 | B2 | 6/2012 | Von Allmen |
| 2010/0155214 | A1 | 6/2010 | Von Allmen |

FOREIGN PATENT DOCUMENTS

| | | |
|---|---|---|
| GB | 696142 | 8/1953 |
| GB | 897370 | 5/1962 |
| JP | 10-241510 A | 9/1998 |

OTHER PUBLICATIONS

International Search Report issued in Applicaiton No. PCT/EP2013/058645 dated Jul. 30, 2013.

Search Report issued in corresponding French Application No. FR 12 53872 dated Jan. 15, 2013.

DEVICE FOR ACTUATING THE CONTACTS OF A CIRCUIT BREAKER, COMPRISING A TORSION ROD

BRIEF SUMMARY OF THE INVENTION

The present invention relates to an actuator device for actuating the contacts of a high or medium voltage circuit breaker.

The circuit breaker comprises a stationary contact and a movable contact, and the actuator device comprises a rigid drive shaft that drives the movable contact, resilient means for driving the movable contact, and a torsion bar for driving the drive shaft, the torsion bar being suitable for being deformed in twisting in order to assist the resilient means during an initial period while opening the contacts of the circuit breaker.

Circuits breakers arranged in gas-insulated substations are fitted with actuator devices. The actuator devices deliver the energy and torque needed to open and close the movable contacts of a circuit breaker. Circuit breakers make use either of hydraulic actuator mechanisms, or of pneumatic actuator mechanisms, or indeed of spring mechanisms. The present invention relates to a spring mechanism.

The present invention has been developed for use preferably in gas-insulated switches. Nevertheless, its application is not limited to gas-insulated circuit breakers. It may also be applied to air-insulated circuit breakers, such as circuit breakers of the "dead tank" or "live tank" types. Furthermore, the present invention applies equally well to switches for use indoors and to switches for use outdoors.

Document GB 897 370 describes a spring actuator mechanism that uses a combination of a first spring and a torsion spring. It has a crankshaft connected to the spring, to a lost-motion coupling mechanism, and a contact. The torsion spring is connected to the crankshaft by a connecting rod, by a pin of the crankshaft and bevel gearwheels, and by the lost-motion coupling.

When the torsion spring relaxes, it closes the contact and loads the spring. In order to facilitate opening of the contact, the lost-motion coupling mechanically decouples the first spring from the torsion spring. The crankshaft can then open the contact without transferring motion to the torsion spring. In other words, that device has two separate springs for opening and for closing the contacts. One of those springs assists the operation of opening a contact, while the other spring delivers the energy needed for closing the contact. In other words, the two springs do not act together to actuate the movable contact. Thus, the device described in that document does not describe a combined spring for optimizing a curve plotting energy or torque as a function of the distance between the contacts of a circuit breaker. Furthermore, the torsion spring shown in that document is a helical spring. That type of spring is not optimized from the compactness point of view since it has a housing that is separate from the crankshaft and the lost-motion coupling. The torsion spring is mechanically connected to the lost-motion coupling by means of two bevel gearwheels. In other words, that device has a large number of parts. From a technical point of view, it is complex to make.

A device is also known from GB 696 142 in which steel torsion bars assist in separating contacts inside a circuit breaker. In that device, the torsion bars apply their maximum torque at the beginning of the opening operation. The device described has two torsion bars that are arranged symmetrically relative to a resilient torsion lever. The lever is used for loading and unloading the steel torsion bars and it is arranged between two contact-raising levers. During the initial portion of the opening operation, the steel torsion bars apply additional torque via the contact-raising levers. Thus, they separate the movable contacts from the circuit breaker.

Each torsion bar is surrounded coaxially by a torsion tube. The torsion bars and the torsion tubes may be deformed elastically in twisting by means of the torsion spring lever. For this purpose, each torsion tube is prevented from turning relative to the torsion spring lever. Furthermore, each torsion bar is prevented from turning at its distal end relative to the torsion tube that it surrounds.

When a torsion bar is put under tension by the torsion spring lever, it acts at its distal end to transmit a fraction of the torque to the torsion tube. Consequently, the torsion spring is put under tension at its distal end and the support element relative to which it is prevented from turning. That device has two torsion bars and two torsion tubes. Consequently it has a large number of components, thereby reducing its reliability. Reliability is of major importance in spring actuator devices. Each additional component represents an additional risk of failure.

Furthermore, torsion tubes and torsion bars act like a composite torsion spring. The springs need to be prevented from turning at three locations:

- the torsion spring must be prevented from turning relative to the support element;
- each torsion bar is prevented from turning at its distal end relative to the torsion tube; and
- finally each torsion bar is prevented from turning relative to a torsion spring lever.

There are two composite torsion spring devices, which means that there are six locations where turning needs to be prevented between the elements that are subjected to twisting tension.

Given that each of those six elements might fail, the risk of failure is high.

A lost-motion element that acts like a brake is also known from JP 10 241510. A rotary cylindrical body is surrounded by an annular cylinder. The annular cylinder has a plurality of orifices along its outer perimeter. Circularly arcuate clearance is provided inside the annular cylinder. It is in the shape of a sector. A piston mounted outside the cylindrical rotary body penetrates into the circular cylindrically arcuate clearance. The orifices facilitate exhausting a stream of fluid from the clearance of circularly arcuate shape to the outside of the annular cylinder.

When the cylindrical rotary body turns counterclockwise, the piston expels the fluid from the clearance of circularly arcuate shape via the orifices. The orifices are of calibrated diameter so that the stream of fluid being exhausted from the clearance of circularly arcuate shape is limited. Consequently, the piston and the rotary body can move at no more than a limited speed such that the device acts as a brake. That device requires a container for receiving the working fluid. Furthermore, the fact that the device acts as a brake prevents a maximum speed being reached between the stationary and movable contacts of a circuit breaker.

The present invention solves the problem consisting in developing an actuator device for actuating the contacts of a two-cycle circuit breaker. High voltage circuit breakers in networks operating at 60 hertz (Hz) are often required to clear a fault within two cycles, such that their break time must be limited to 33.3 milliseconds (ms). In order to clear a 60 Hz fault successfully, the relative speed of the contacts inside the circuit breaker must be maximized.

More precisely, the relative speed between the contacts inside a circuit breaker at the moment the contacts separate is crucial for extinguishing an arc that appears between the contacts. An object of the present invention is thus to optimize the relative speed between a stationary contact and a movable contact at the moment the contacts separate.

Another object of the present invention is to provide an actuator device for actuating contacts that minimizes the amount of energy stored in its springs. In other words, the energy and the torque for all relative positions of the stationary and movable contacts of a circuit breaker should be as close as possible to the ideal curve. The optimum for this curve of energy relative to the distance between the contacts is determined by the objective of extinguishing the arc.

According to another characteristic, the actuator device must also be compact. Another problem on which the invention is based is consequently that of proposing an actuator device of dimensions that are minimized.

In accordance with the invention, these objects are achieved by the fact that the torsion bar is housed inside the drive shaft, a first end of the torsion bar is constrained to turn with a ring, a second end of the torsion bar being constrained to turn with the drive shaft, and there being only one drive shaft and only one torsion bar.

By means of these characteristics, the device has only one torsion bar, unlike the device described in document GB 696 142. The number of parts is therefore reduced and consequently the complexity of the system is reduced. Furthermore, the torsion bar is prevented from turning at each of its ends, which amounts to two connections that prevent turning, as compared with six such connections in document GB 696 142. Furthermore, given that the torsion bar is housed inside the drive shaft, the physical size of the device is reduced. An actuator device is thus obtained that is compact. Preferably, the resilient means are constituted by at least one helical spring.

Advantageously, the actuator device includes a lost-motion element that is constituted by two abutment elements and by said ring, two pistons spaced angularly from each other and secured to the ring, the pistons being suitable for coming into abutment against the abutment during turning of the shaft.

In a particular embodiment, the actuator device of the invention includes a lever suitable for exerting traction on a chain, thereby compressing the helical spring.

BRIEF DESCRIPTION OF THE DRAWINGS

Other characteristics and advantages of the invention appear further on reading the following description of an embodiment given by way of illustration with reference to the accompanying figures. In the figures.

DETAILED DESCRIPTION OF THE INVENTION

Figure 1:
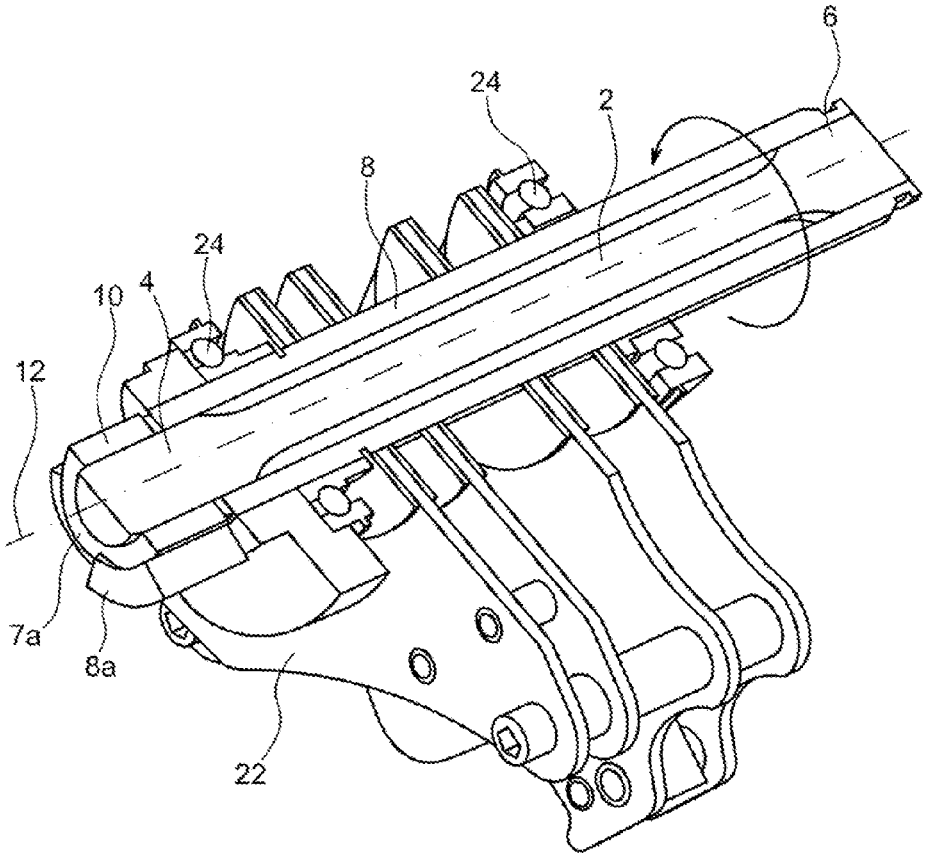
FIG. 1 is a perspective view, partially in section, showing an actuator device in accordance with the present invention for actuating the contacts of a circuit breaker.

FIG. 1 shows an actuator device for actuating the contacts of a high or medium voltage circuit breaker. It includes a torsion bar 2. The torsion bar 2 has a central portion of smaller diameter, and first and second ends 4 and 6 of larger diameter. The torsion bar 2 is housed inside a drive shaft 8. The second end 6 of the torsion bar 2 is prevented from rotating relative to the drive shaft 8, e.g. by means of fluting or teeth. Other means for preventing rotation could be used, e.g. a key or a pin. At its first end 4, the torsion bar is prevented from rotating relative to a ring 10.

The torsion bar 2 and the drive shaft 8 are coaxial about an axis 12 drawn as a chain-dotted line.

The first end of the torsion bar 4 together with its central portion can turn inside the drive shaft 8. The torsion bar 2 can be deformed in twisting. In contrast, the drive shaft 8 is rigid. It does not deform in twisting. Nevertheless, it can turn about its longitudinal axis 12.

At the first end 4 of the torsion bar 2, the clearance between the torsion bar and the drive shaft 8 is reduced to the minimum. The purpose of this arrangement is to prevent any movement of the first end 4 of the torsion bar in a direction perpendicular to the axis of rotation 12 of the drive shaft 8. In other words, the first end 4 of the torsion bar is capable only of turning about the axis of rotation 12.

Figure 2:
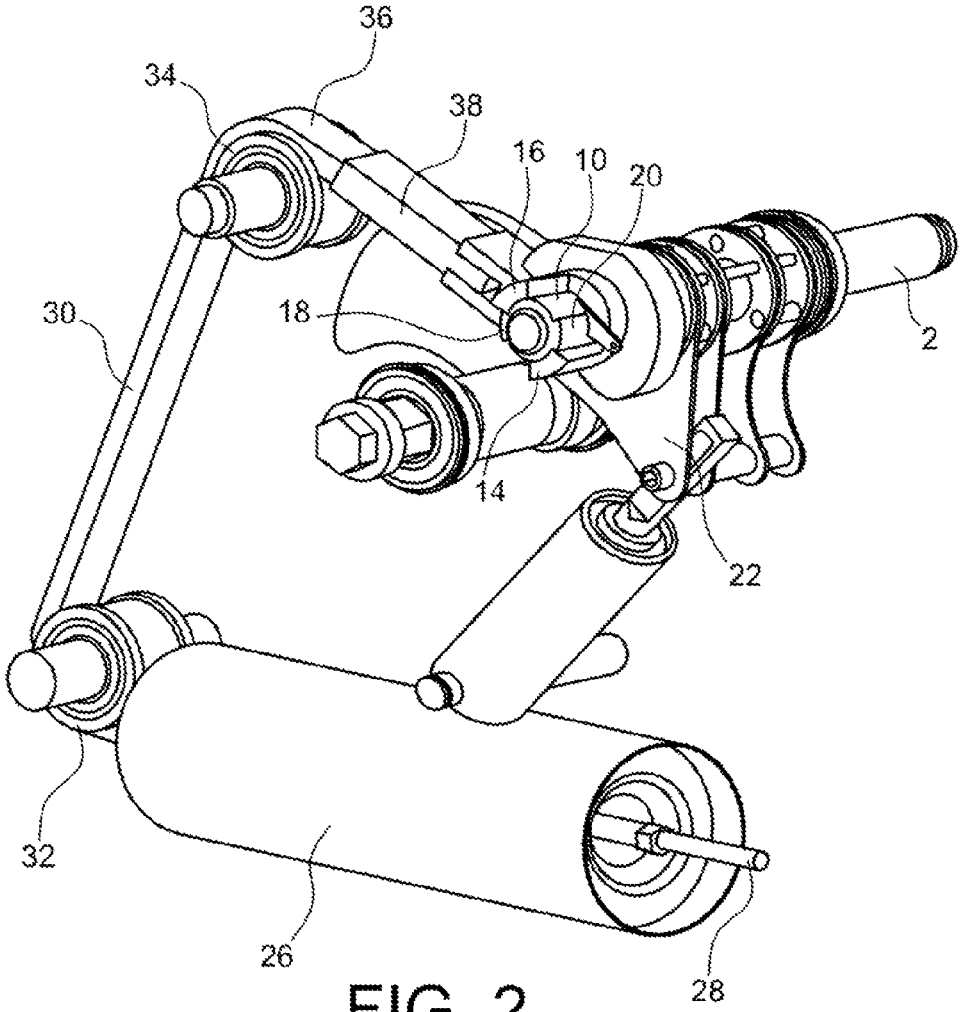
FIG. 2 is a perspective view from another angle showing the device for actuating the contacts of a circuit breaker as shown in FIG. 1.

FIG. 2 shows the lost-motion element. It is constituted by two stop elements 14 and 16 and by the ring 10 having two pistons 18 and 20. Preferably, the pistons 18 and 20 are made integrally with the ring 10. The abutment elements 14 and 16 together with the pistons 18 and 20 are arranged symmetrically about the axis of rotation 12. In accordance with the invention, the ring 10 is constrained to rotate with the first end 4 of the torsion bar 2. Consequently, the pistons 18 and 20 are also constrained to rotate relative to the torsion bar 2. Rotation of the pistons 18 and 20 and of the ring 10 in a clockwise direction or in a counterclockwise direction is limited by the abutments of the abutment elements 14 and 16. The abutment elements 14 and 16 are rigidly connected to the housing of the device for actuating the contacts and they do not move. When the pistons 18 and 20 are in their position shown in FIG. 2, their radial surfaces come into contact with the radial surfaces of the abutment elements 14 and 16.

With reference once more to FIG. 1, reference 22 designates a lever. This lever is connected in non-pivoting manner to the drive shaft 8. When the lever 22 turns, the drive shaft 8 and the second end 6 of the torsion bar 2 turn in the same direction. Two bearings 24, e.g. ball bearings, facilitate turning movement of the above assembly relative to the housing of the actuator device.

With reference now to FIG. 2, the actuator device includes a housing 26 with a spring. One end of the spring is fastened to a rod 28. The other end of the rod 28 is fastened to a chain 30. The chain 30 passes over two wheels 32 and 34 that are movable in rotation. The other end of the chain, i.e. the end that is not fastened to the rod 28, and that is given the reference 36, is fastened to an attachment 38.

The positions of the pistons 18 and 20 relative to the abutment elements 14 and 16 as shown in FIG. 2 indicate that neither the torsion bar 2 nor the helical spring contained in the housing 26 are loaded. In order to load the torsion bar 2 and the helical spring contained in the housing 26, the lever 22 and the drive shaft 8 are turned counterclockwise. The lever 22 pulls the top end of the chain 30 to the right (in FIG. 2), thereby compressing the helical spring contained in the housing 26.

Simultaneously, the pistons 18 and 20 turn counterclockwise. They continue turning until their radial surfaces come into contact with the abutment elements 14 and 16. Once the pistons 18 and 20 have reached their final position, they can no longer continue turning. However, the lever 22 and the drive shaft 8 continue turning in the counterclockwise direction. The first end 4 of the torsion bar 2 is then blocked by engaging between the pistons 18 and 20 and the abutment elements 14 and 16.

Consequently, continued turning in the clockwise direction of the second end 6 of the torsion bar 2 serves to deform the torsion bar 2 in twisting. In other words, the torsion bar 2 is loaded. When the pistons 18 and 20 come into contact with the abutment elements 14 and 16, the lever typically continues to turn through an angle of 10° to 40°, until the torsion bar is fully loaded.

The torsion bar 2 and the helical spring contained in the housing 26 need to relax in order for the actuator mechanism to actuate the movable contacts of a circuit breaker. When that occurs, the lever 22 turns clockwise. So long as the pistons 18 and 20 are in contact with the abutment elements 14 and 16, the torsion bar 2 applies additional torque to the drive shaft 8.

After turning through an angle lying in the range 10° to 40°, these pistons 18 and 20 are no longer in contact with the abutment elements 14 and 16. The torsion bar 2 no longer drives the drive shaft 8. Only the helical spring contained in the housing 26 continues to deliver torque.

Figure 3:
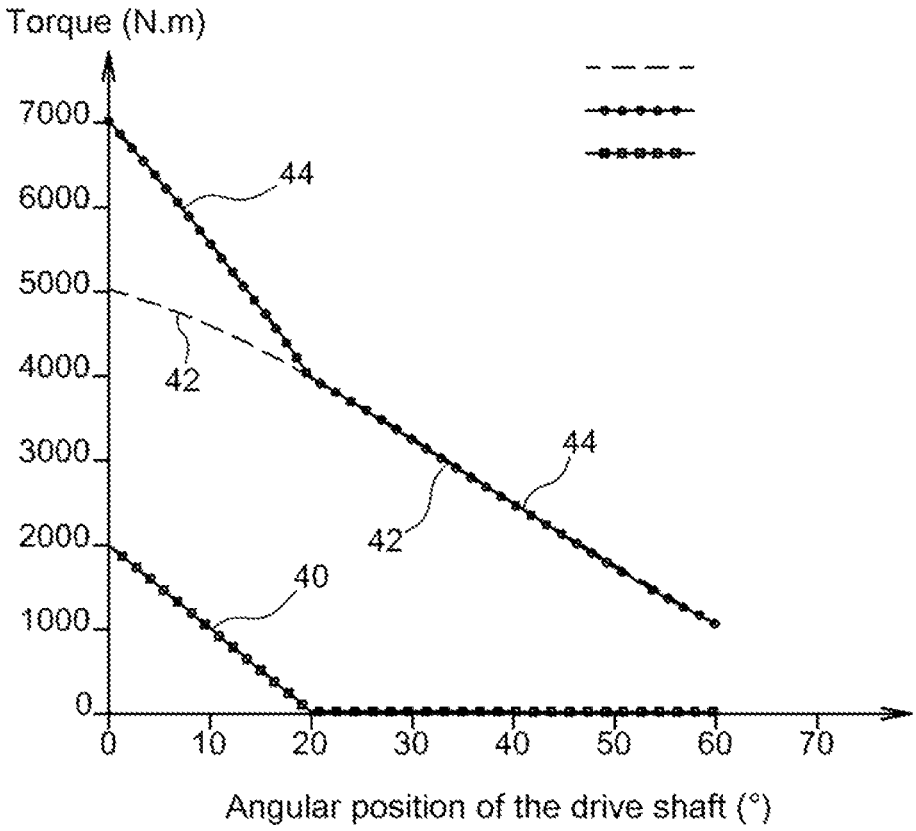
FIG. 3 is a graph showing the contact-actuating torque as a function of the angular position of the drive shaft.

FIG. 3 plots torque as a function of the angular position of the drive shaft. Curve 40 represents the additional torque coming from the torsion bar 2. As shown in FIG. 3, the torsion bar delivers additional torque for angular positions of the drive shaft lying in the range 0° to 20°. This range covers the angular position of the drive shaft 8 during which the contacts inside the circuit breaker are accelerating. Thus, the invention solves the problem that consists in optimizing the relative speed between the contacts of a circuit breaker at the instant when the contacts separate, as explained above. In the example shown, the torsion bar 2 does not deliver any additional torque for angular positions of the drive shaft 8 situated beyond 20°.

Curve 42 shows the torque delivered by the helical spring contained in the housing 26 on its own. Unlike the torque delivered by the torsion bar, the helical spring contained in the housing 26 delivers torque over the full range of angular positions of the drive shaft 8. In other words, the curve showing the torque delivered by the helical spring contained in the housing 26 as a function of the angular position of the drive shaft 8 is a curve that is continuous over the range 0° to 60°. The curve 44 shows the total of the contributions from the helical spring contained in the housing 26 and the torsion bar 2. Because of the force delivered by the torsion bar 2, the curve presents a steeper slope for angular positions lying in the range 0° to 20° than it does for angular positions situated beyond 20°. The total torque is close to the optimum curve for torque as a function of the distance between the contacts of the circuit breaker. The bottom portion of the curve 42 is superposed on the curve 44 such that they cannot be distinguished in FIG. 3.

Consequently, the present invention provides an actuator device for actuating the contacts of a high or medium voltage circuit breaker that presents improved effectiveness. The torsion bar 2 delivers additional torque, but only at the beginning of an opening operation, and the torque delivered by the helical spring housed inside the housing 26 can therefore be smaller. Consequently, the total energy stored in the actuator device may be reduced by as much as 50% compared with a solution that does not include a torsion bar.

What is claimed is:

1. An actuator device for actuating the contacts of a high or medium voltage circuit breaker having at least one movable contact, the device comprising:

a rigid drive shaft that drives the at least one movable contact, resilient means for driving the at least one movable contact, a torsion bar for driving the drive shaft and a lost-motion element through which the torsion bar is configured for applying a torque to the drive shaft during an initial period of an opening operation of the at least one moveable contact of the circuit breaker, wherein the torsion bar is housed inside the drive shaft, a first end of the torsion bar being constrained to turn with a ring of the lost-motion element, a second end of the torsion bar being constrained to turn with the drive shaft, the actuator device comprising only one drive shaft and only one torsion bar.

2. An actuator device according to claim 1, wherein the resilient means are constituted by at least one helical spring.

3. An actuator device according to claim 1, wherein the lost-motion element is constituted by two abutment elements and by said ring, by two pistons spaced angularly from each other and secured to the ring, the pistons being configured for coming into abutment against the abutment elements during turning of the drive shaft.

4. An actuator device according to claim 1 further comprising a lever configured for exerting traction on a chain, thereby compressing the resilient means.

5. The actuator device according to claim 1, wherein the torsion bar applies the torque to the drive shaft only during the initial period of the opening operation of the contacts of the circuit breaker.

6. The actuator device according to claim 5, wherein the initial period of the opening operation of the contacts of the circuit breaker corresponds to the drive shaft turning through a predetermined angle.

7. The actuator device according to claim 6, wherein the predetermined angle of the drive shaft is between about 10 degrees and about 40 degrees.

* * * * *